United States Patent [19]

Littwin

[11] 4,329,617

[45] May 11, 1982

[54] CONTROL PLATE FOR A FLAT PLASMA SCREEN

[75] Inventor: Burkhard Littwin, Hohenschaeftlarn, Fed. Rep. of Germany

[73] Assignee: Siemens Aktiengesellschaft, Berlin & Munich, Fed. Rep. of Germany

[21] Appl. No.: 82,168

[22] Filed: Oct. 5, 1979

[30] Foreign Application Priority Data

Oct. 12, 1978 [DE] Fed. Rep. of Germany ..... 2844512

[51] Int. Cl.[3] ..... H01J 1/88; H01J 19/42

[52] U.S. Cl. ..... 313/268; 313/491; 313/492; 313/506; 313/355

[58] Field of Search ..... 313/491, 493, 268, 355, 313/492, 506

[56] References Cited

U.S. PATENT DOCUMENTS

| | | | |
|---|---|---|---|
| 3,744,247 | 7/1973 | Margosian et al. | 313/355 |
| 3,753,022 | 8/1973 | Fraser et al. | 313/355 |
| 3,755,704 | 8/1973 | Spindt et al. | 313/309 |
| 4,066,923 | 1/1978 | Van Esdonk | 313/355 |
| 4,112,329 | 9/1979 | Veith | 313/491 |
| 4,160,191 | 7/1979 | Hausfeld | 313/491 |
| 4,213,072 | 7/1980 | Veith et al. | 313/491 |

*Primary Examiner*—Saxfield Chatmon, Jr.

*Attorney, Agent, or Firm*—Hill, Van Santen, Steadman, Chiara & Simpson

[57] ABSTRACT

A control plate for a flat plasma screen, comprising a carrier plate of multi-layer construction, having at least three layers, the middle layer of which is of metal and the outer layers of which are glass. In the manufacture of the control apertures which extend through the control plate, an etching procedure may be employed, involving a series of etching steps with different etching agents, whereby only slight underetchings arise and the control plate maintains sufficient mechanical stability, even with a medium overall thickness. The manufacture of the control apertures may also be effected by a laser-boring operation or the like, in which the metallic middle layer carries off heat developed during the operation, whereby no thermal fissure formations are created.

13 Claims, 2 Drawing Figures

CONTROL PLATE FOR A FLAT PLASMA SCREEN

BACKGROUND OF THE INVENTION

The invention is directed to a control plate for a flat plasma screen employing a carrier plate which on one side thereof carries parallel control electrode paths corresponding to the lines of the screen and on the other side of the plate carries a series of parallel control electrode paths which extend in a direction perpendicular to the series of electrode paths on the first side of the plate and correspond to the columns of the screen, with the carrier plate having control apertures extending therethrough located at the intersections or crossing points of the respective series of control electrode paths on the opposite sides of the plate.

A control plate of this type functions to effect the matrix selection of the individual image or picture points of, in this case, a flat plasma screen. By suitable selection of a line and a column, i.e. selection of the corresponding line column electrode paths, the control aperture at the intersection point of the selected line and column electrodes is unblocked or released, whereby electrons from the plasma of the gas discharge space of the structure lying behind the control plate can be discharged into the acceleration space which lies in front of the control plate, wherein they are accelerated and upon striking the adjacent face of the screen generate a point or spot of light (a scanning spot), with the sequential scanning and production of such light points producing the desired video image on the screen. A description of this type of two-chamber operation can, for example, be found in German OS No. 2,615,721. This German publication also illustrates a construction of a control plate comprising a carrier plate formed of glass, with the control electrode paths being disposed on opposite sides of the plate, and the respective control apertures being produced in the plate by means of chemical etching.

Problems arise in the production of etched plates of this type as a result of the necessity of utilizing a glass plate of sufficient thickness to provide adequate stability. It will be appreciated that as the thickness of the plate is increased, deeper control apertures must be etched into the plate, and as a result the underetchings produced under the mask which is used laterally in plate direction, correspondingly increase, resulting in a reduction in the mechanical stability of the plate, particularly with the prerequisite of a sufficiently large number of control apertures, which again is dependent upon the number of image or picture points required, etc. Further, the aperture cross section present must be sufficient to enable as many electrons as possible to flow from the discharge space through the selected control aperture into the acceleration space. However, the size of the control apertures is limited not only by the requirements for sufficient mechanical stability and for sufficient number of control apertures, but also by the requirement that no electrons should be permitted to pass through unselected control apertures or apertures which are only partially selected, i.e. half selected by the application of control voltage to only an electrode at one side of the plate, and further the requirement of the electric penetration factor of the acceleration anode, which is applied to the front plate, through the control apertures into the discharge space remains as small as possible.

SUMMARY OF THE INVENTION

The present invention is directed to the problem of so-designing a control plate structure that it satisfies both the requirements for mechanical stability and those with respect to the electrical characteristics of the resulting structure.

The problem of so designing a control plate of the kind initially mentioned, in accordance with the invention, is solved by utilizing a carrier plate of laminated construction comprising at least three layers, of which the middle layer consists of metal and the remaining outer layers consist of insulating material. In accordance with one embodiment of the invention, the outer layers may comprise glass plates which are sintered onto respective glass solder layers, provided on the surface of the middle metallic layer. A less costly solution may be achieved by employing a sintered glass solder powder for the formation of the soldered-on glass plates forming the outer insulating layers.

In accordance with a further advantageous feature, the glass solder layers disposed directly on the metal layer comprise a crystallizing glass solder which can be sprayed and sintered onto the metal layer, while the outer layers comprise a stable glass solder which is sprayed and sintered onto the first layer. This arrangement makes use of the respective characteristics of the two types of glass solder, a layer of crystallizing glass solder contacting the metal middle layer possessing adhesion characteristics which are superior to those of stable glass solder, while the use of the stable glass solder for the outer layers results in a smoother surface than could be achieved by employing a crystallizing glass solder. Thus, by forming the insulating layer out of two different glass solders, the desired characteristics of both are favorably combined. The term "stable" is to be understood as being directed to glass solder which remains amorphous, whereas the crystallizing glass solder crystallizes above a certain temperature and remains crystalline following cooling.

By the utilization of such a laminated construction of the carrier plate, a control plate can be produced having adequate mechanical stability without, at the same time, requiring an excessively thick structure. Likewise, the control apertures can be accurately maintained at the desired size.

With respect to production operations, a selective chemical etching of the individual layers successively one after another can be effected, as is known from German AS No. 2,013,196 for a metal layer construction, and in addition thereto, suitable aperture formation can also be effected by methods employing an ion beam or a laser beam. Both of the last two methods referred to offers the advantage that heat developed in the etching or boring operation can be drawn off through the intermediate middle layer to eliminate thermal shocks in the glass layers which would result in fissures therein, and which would also have an undesirable influence on the mechanical stability. Further, it is advantageous if the mean heat expansion coefficient of the complete control plate is matched to that of the screen.

An additional advantage of the use of an intermediate metallic layer is in the reduction in static charges at the edges of the control apertures. In addition thereto, the intermediate metallic layer can also be utilized as a potential-determining electrode in the aperture selection operation. Preferably, it is formed from a metal, the heat expansion coefficient of which is matched to that of the glass, for example, constructed from a NiFeCo alloy (Vacovit). In such cases it is advantageous to provide surface layers of aluminum on such intermediate metal layer.

DETAILED DESCRIPTION OF THE INVENTION

Figure 1:
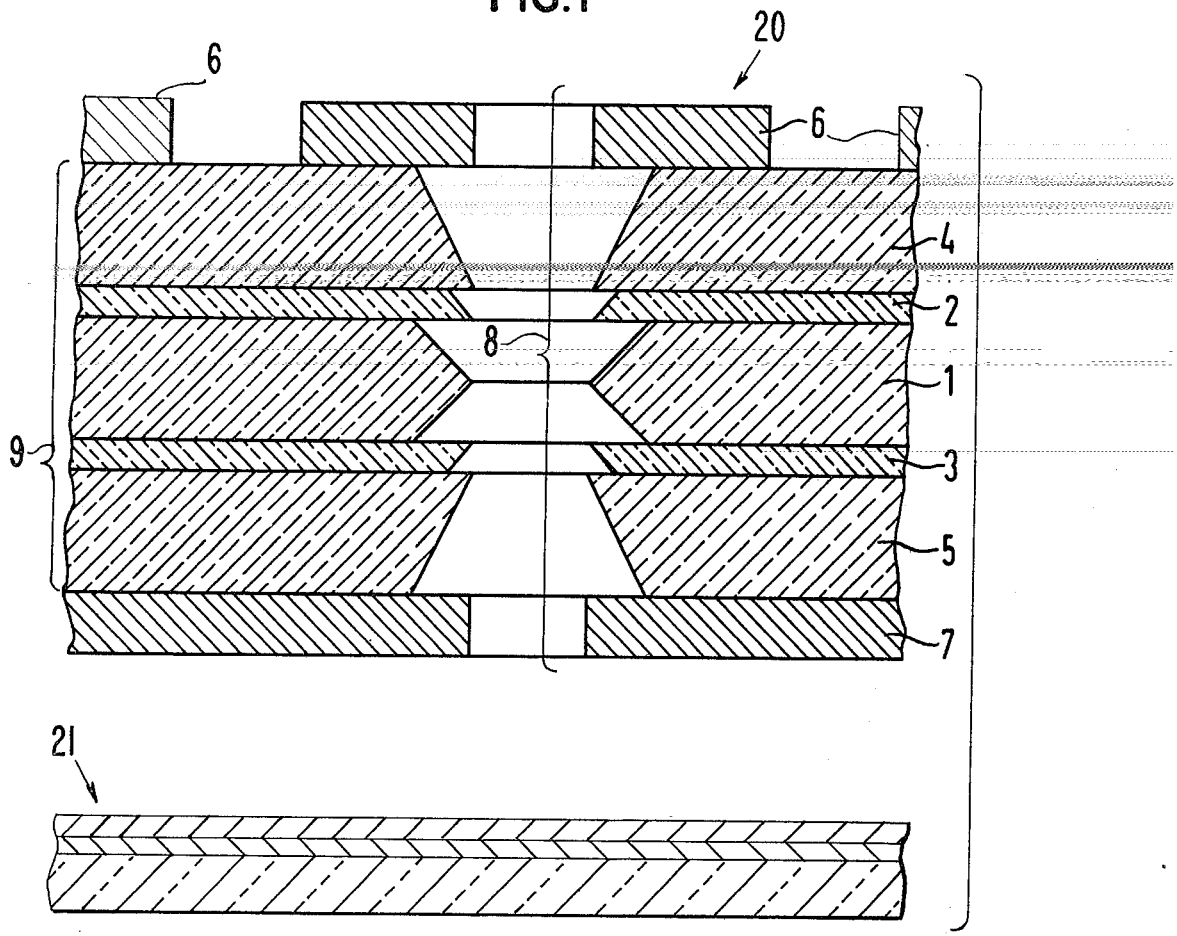
FIG. 1 is a partial cross-section of a control plate and plasma screen in accordance with the present invention.

Referring to the drawing, only a portion of a control plate 20 is illustrated and for the understanding of its function with respect to a plasma screen 21 of a plasma screen display device, attention is invited to German OS No. 2,615,721, previously referred to.

In the drawing, in which only a section through one of the control apertures is illustrated, the reference numeral 1 designates a central or intermediate metal layer of NiFeCo alloy with a thickness of, for example, 80 $\mu$m, each face of which is coated with a layer 2 or 3, respectively, of a glass solder. Disposed upon the glass solder layer 2 is a glass layer 4, and in like manner, disposed upon the glass solder layer 3 is a glass layer 5, both of which layers are, for example, 80 $\mu$m thick glass plates. The layers 1–5 thus form the carrier structure or carrier plate 9 of the control plate 20.

Disposed on the exterior face of the glass layer 4 are a plurality of metal control electrodes or electrode paths 6 which appears in transverse section. Likewise, disposed upon the exterior face of the glass layer 5 is a series of metallic control electrodes or electrode paths 7 (only one of which is illustrated), which extends at right angles to the first series of electrodes on the face of the glass layer 4, and thus the control electrode 7 is depicted in longitudinal section. The control aperture 8 thus is disposed at the intersection of the two electrodes 6 and 7 and thus marks the matrix point of the corresponding line or row and column.

Figure 2:
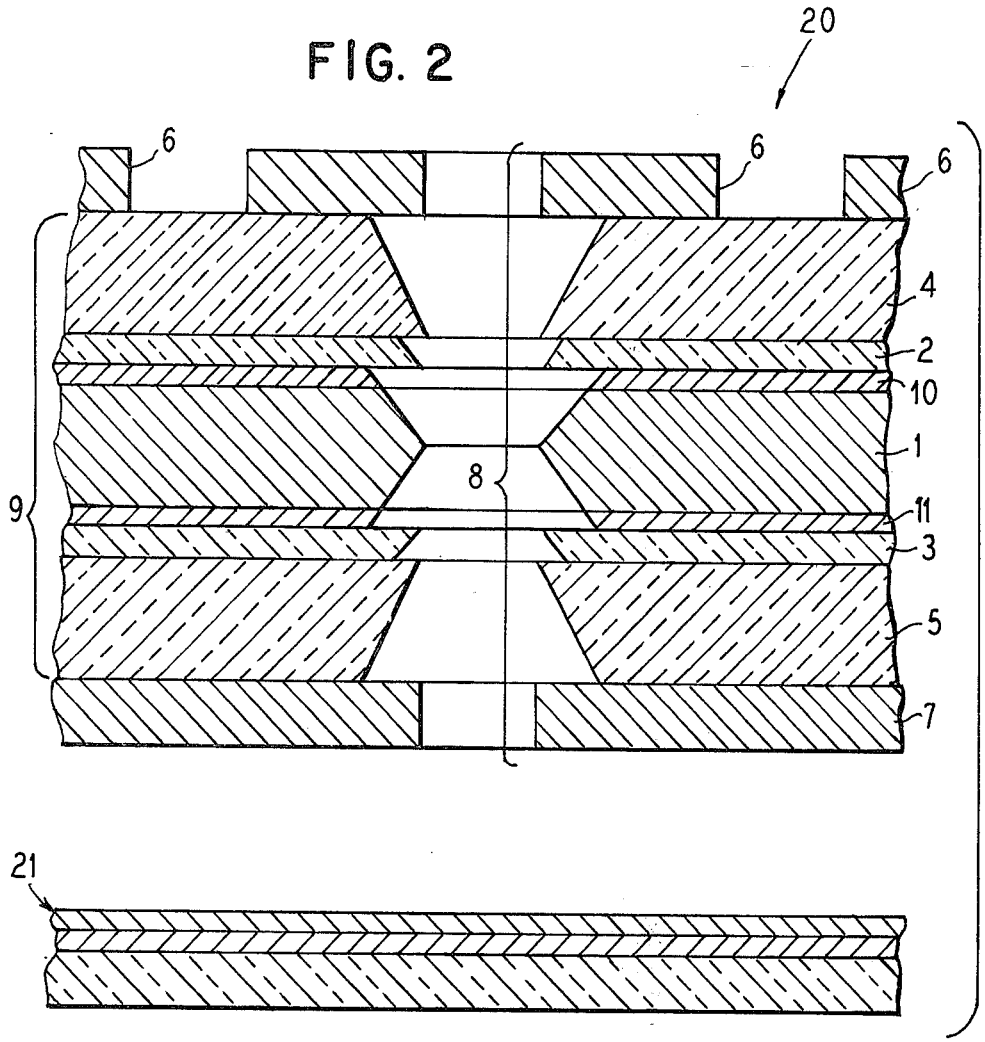
FIG. 2 is a partial cross-section of an embodiment of the control plate in accordance with the present invention.

The control aperture 8 extends completely through all carrier plate layers 1 through 5 and through the control electrodes 6 and 7 in a direction perpendicular to the control plate surfaces. It is produced, for example by means of thermal etching. If the carrier plate is formed from a material, for example, NiFeCo alloy, it is advantageous to initially suitably apply a very thin coating 10 and 11 (FIG. 2) of aluminum on the faces of the metal layer 1, after which the latter is sprayed on both faces with glass solder powder, followed by application of the glass layers in the form of glass solder powder (for example, Schott 8596), in a spraying operation. Following the drying of the powder, the layers 1, 4 and 5 are pressed together between two spaced metal plates, at a temperature of, for example, 520° C., which permits the glass solder powder to sinter together, thereby producing the glass solder layers 2 and 3, which secure the glass layers 4 and 5 to the metal layer 1.

Following completion of the structure thus far, the metallic control electrode paths 6 and 7 are then applied to the outer faces of the carrier plate. These can be produced, as a practical matter, by the galvanic deposition of metal layers upon a thin continuous contact layer which was previously metallized on the plate, utilizing a suitable photo sensitive resist mask to delineate the desired electrode paths.

Following the construction of the control electrode paths 5 and 7, the control apertures may be produced by means of a series of etching steps. By means of a corresponding masking during the galvanic deposition, the control holes are initially produced in the control electrode paths 6 and 7. A second masking leaves open only the control locations which are to be etched into the glass layers 4 and 5. An etching operation utilizing dilute hydrofluoric acid is then employed to etch control apertures extending through the glass layers 4 and 5 up to the glass solder layers 2 and 3. The latter layers may then be etched with nitric acid solution, mixed with hydrofluoric acid, until the apertures formed thereby expose the metal layer 1. Etching of the control apertures through the metal layer 1 may then be effected, for example, with a ferric fluoride solution in which the glass solder layers 2 and 3 function as a mask for such etching operation. By means of such sequential etching operations, relatively minor underetchings take place in the plate, in lateral directions, as each previously etched layer successively serves as a mask for the next following etching operation. Instead of employing a series of etching operations to produce the control apertures in the control plate, it is also possible to produce such apertures by the utilization of an ion beam operation or a laser beam operation. The laser beam method, in particular, enables the production of precise apertures. The metallic middle layer 1, in such a case functions as a heat sink operative to draw off heat developed during the operations, so that no local thermal stresses can arise in the glass layers 4 and 5, thereby eliminating the danger of fissure formations, etc.

Although I have described my invention by reference to particular illustrative embodiments, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. In a control plate for a matrix drive of individual picture points formed by intersecting rows and columns of control electrodes of the control plate on a screen of a flat plasma display device, said control plate having a carrier plate consisting of at least partially electrically insulating material, said carrier plate carrying on one plate surface control electrodes corresponding to the rows of the picture points, said control electrodes being parallel to one another and electrically insulated from one another, and said carrier plate on the other plate surface carrying control electrodes corresponding to the columns for the picture points, said control electrodes for all columns being perpendicular to the control electrodes for all rows, parallel to one another and electrically insulated from each other, said carrier plate having a control aperture which passes through the control electrodes at each point of intersection of said control electrodes for all rows and columns, the improvements comprising the carrier plate being constructed of at least three layers with a central layer being a continuous metallic layer and being disposed between two outer layers consisting of electrically insulating material.

2. In a control plate according to claim 1, wherein the central metallic layer comprises a metal layer having an aluminum coating on each surface.

3. A control plate according to claim 2, wherein the mean thermal expansion coefficient of the control plate is matched to that of the screen.

4. In a control plate according to claim 1, wherein the mean thermal expansion coefficient of the control plate is matched to that of the screen.

5. In a control plate according to claim 1, wherein the central metallic layer comprises a layer of NiFeCo alloy with an aluminum coating on each surface.

6. In a control plate according to claim 1, wherein each outer layer comprises a glass plate, each glass plate being secured to the central metallic layer by a glass solder layer.

7. A control plate according to claim 6, wherein the glass plates of the outer layers comprise a sintered glass solder powder.

8. A control plate according to claim 7, wherein the inner glass solder layers contacting the metallic layer respectively comprise a sintered on crystallizing glass solder, and the outer layers comprise a sintered on stable glass solder.

9. In a control plate according to claim 8, wherein the central metallic layer comprises a metal layer having an aluminum coating on each surface.

10. In a control plate according to claim 8, wherein the mean thermal expansion coefficient of the control plate is matched to that of the screen.

11. In a control plate according to claim 6, wherein the central metallic layer comprises a metal layer having an aluminum coating on each surface.

12. In a control plate according to claim 6, wherein the mean thermal expansion coefficient of the control plate is matched to that of the screen.

13. A control plate according to claim 9, wherein the mean thermal expansion coefficient of the control plate is matched to that of the screen.

* * * * *